United States Patent [19]

Bailey et al.

[11] Patent Number: 5,035,292

[45] Date of Patent: Jul. 30, 1991

[54] WHIPSTOCK STARTER MILL WITH PRESSURE DROP TATTLETALE

[75] Inventors: Thomas F. Bailey; John E. Campbell, both of Houston; Edmond Kagler, Jr., Sugarland, all of Tex.

[73] Assignee: MASX Energy Service Group, Inc., Houston, Tex.

[21] Appl. No.: 296,249

[22] Filed: Jan. 11, 1989

[51] Int. Cl.[5] ..... E21B 47/02

[52] U.S. Cl. ..... 175/45; 175/48; 175/61; 175/75; 175/76

[58] Field of Search ..... 175/21, 24, 25, 27, 175/38, 39, 48, 61, 75, 76, 220, 231, 45

[56] References Cited

U.S. PATENT DOCUMENTS

| | | | |
|---|---|---|---|
| 2,020,471 | 11/1935 | Layne | 166/38.2 |
| 3,115,935 | 12/1963 | Hooton | 116/117.6 |
| 3,397,746 | 8/1968 | Link | 166/117.6 |
| 3,509,144 | 5/1969 | Grable et al. | 544/408 |
| 3,891,034 | 6/1975 | Owen et al. | 166/133 |
| 3,908,759 | 9/1975 | Cagle et al. | 166/117.6 |
| 4,153,109 | 5/1979 | Szescila | 166/250 |
| 4,285,399 | 8/1981 | Holland et al. | 166/113 |
| 4,304,299 | 12/1981 | Holland et al. | 166/255 |
| 4,354,560 | 10/1982 | Johnson | 175/267 |
| 4,397,355 | 8/1983 | McLamore | 166/297 |
| 4,614,242 | 9/1986 | Rives | 175/269 |
| 4,893,675 | 1/1990 | Skipper | 175/269 |

*Primary Examiner*—Ramon S. Britts
*Assistant Examiner*—Roger J. Schoeppel
*Attorney, Agent, or Firm*—Edgar A. Zarins; Malcolm L. Sutherland

[57] ABSTRACT

A whipstock mill for milling through the casing wall which incorporates a pressure drop tattletale to signal the operator that the milling operation should be halted. The milling tool includes a longitudinal fluid passageway which communicates with a lateral port formed below the mill blades. A replaceable plug is utilized to initially close the port thereby restricting fluid flow into the well hole. The starter mill is preferably run into the hole with a whipstock which can be set in the hole using an integral packer. As the mill travels down the set whipstock, a shear block mounted to the whipstock will shear the plug at a predetermined depth of the mill opening the lateral port. The resulting pressure drop within the milling tool signifies that the mill has reached the desired depth. Accordingly, the milling operation can be halted and the mill retrieved to permit further operations through the casing wall.

22 Claims, 2 Drawing Sheets

Fig-6
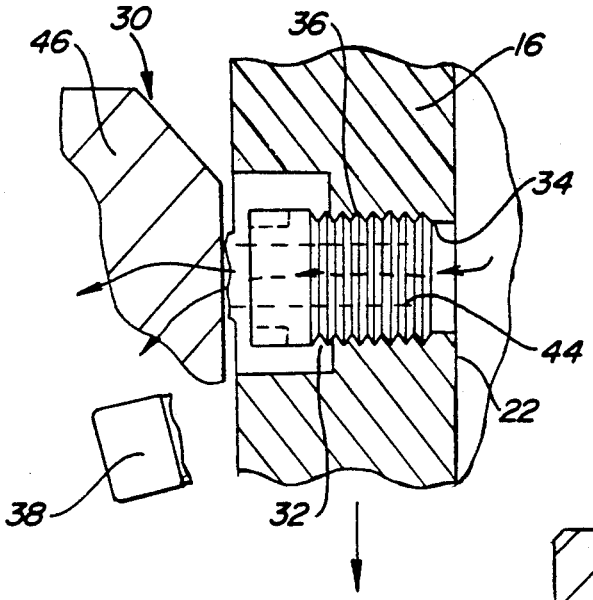
Fig-7
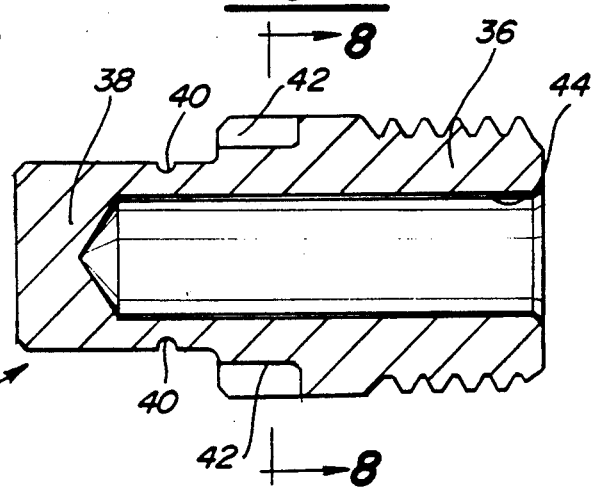
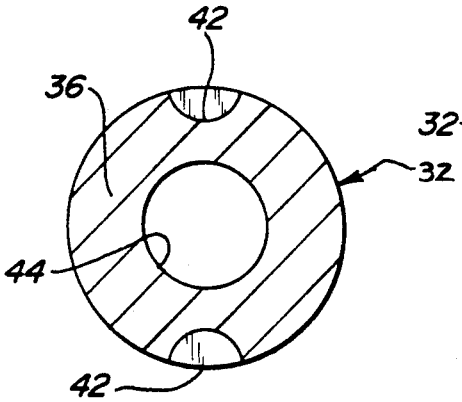
Fig-8
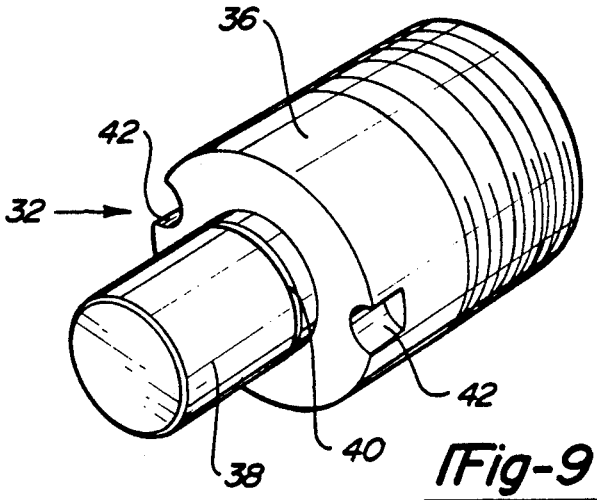
Fig-9

WHIPSTOCK STARTER MILL WITH PRESSURE DROP TATTLETALE

BACKGROUND OF THE INVENTION

I. Field of the Invention

This invention relates to a whipstock starter mill for redirecting a drill bit or cutter at an angle from the well casing and, in particular, to a tattletale assembly associated with the whipstock and mill for creating an in-line pressure drop when the mill has reached a predetermined depth along the whipstock II. Description of the Prior Art Whipstocks have long been used in drilling to direct a drill bit or cutter at an angle from the set casing. The whipstock may be set within the casing above the bottom of the well bore using a packer which may be run separately or together with the whipstock in one trip. In the one-trip packstock mill, the mill tool, whipstock and packer are run into the hole integrally and the packer is set at the desired depth. With the packstock set, the mill is detached from the whipstock and the milling operating is initiated. The mill travels down the angled surface of the whipstock to engage and mill through the casing wall. However, because of the nature of the mill, the casing material and the whipstock, care must be taken to mill only through the casing wall. If the mill travels too far through the casing, the surrounding formation material will cause the mill to mill into the whipstock eventually destroying either the mill or the whipstock. If the casing is not milled completely through, the cutter or drill bit subsequently run into the hole will not travel in the desired direction.

In the past known whipstock operations, the depth of the mill has been largely determined by the operator at the surface. However, such determinations relied on some guess work since deviations in the casing etc. at times belied the actual depth. Because the depth of the mill was largely determined by the total travel into the hole, miscalculations have occurred.

SUMMARY OF THE PRESENT INVENTION

The present invention overcomes the disadvantages of the past known whipstock assemblies by providing a pressure drop tattletale in association with the mill to signal the operator when the mill has reached the predetermined depth.

In a preferred embodiment of the present invention, the packer, whipstock and starter mill are connected to allow one-trip setting of the tool and milling of the casing wall. The anchor-packer is connected to the lower end of the whipstock and the milling tool is releaseably connected to the upper end of the whipstock. A fluid line extending from the mill through the whipstock to the packer is utilized to set the anchor-packer. Once the tool is set, the mill is disconnected from the whipstock and the milling operation is initiated, the milling tool travelling along the sloped surface of the whipstock thereby directing the mill into the casing wall.

The starter mill includes a longitudinal fluid passageway which initially supplies fluid to the fluid line for setting the anchor-packer. A lateral fluid port extends between the central fluid passageway and the exterior of the tool. The port has an increased diameter to allow selective fluid communication between the fluid passageway and the borehole. A replaceable plug is inserted into the port and includes an outer end which extends beyond the periphery of the milling tool. The plug includes a partial bore which extends from the central passageway of the tool to a point just beyond the periphery of the tool. Thus, when the outer end of the plug is sheared off, the partial bore will be opened to allow fluid communication between the central fluid passageway and the interior of the casing.

Mounted to the sloped surface of the whipstock is a shear block. The shear block is mounted at a position such that when the plug on the milling tool is engaged, the tool will be at the desired depth along the whipstock. As the milling tool travels downwardly, the outer end of the plug will be sheared off as it engages the block. As a result, fluid from the central passageway of the milling tool will flow into the casing. The resulting pressure drop within the tool can easily be detected by the surface operator signaling that the milling operation should be halted. The milling tool can then be retrieved from the borehole to initiate subsequent operations.

Other objects, features, and advantages of the present invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing in which like reference characters refer to like parts throughout the views and in which:

FIGURE 6 is an enlarged cross-sectional perspective of the tattletale plug having its outer end sheared by the shear block;

FIG. 7 is a cross-sectional perspective of the tattletale plug embodying the present invention;

FIG. 8 is a cross-sectional perspective of the tattletale taken along lines 8—8 of FIG. 7; and FIGURE 9 is an elevational perspective of the tattletale plug embodying the present invention.

DETAILED DESCRIPTION OF A PREFERRED EMBODIMENT OF THE PRESENT INVENTION

Figure 1:
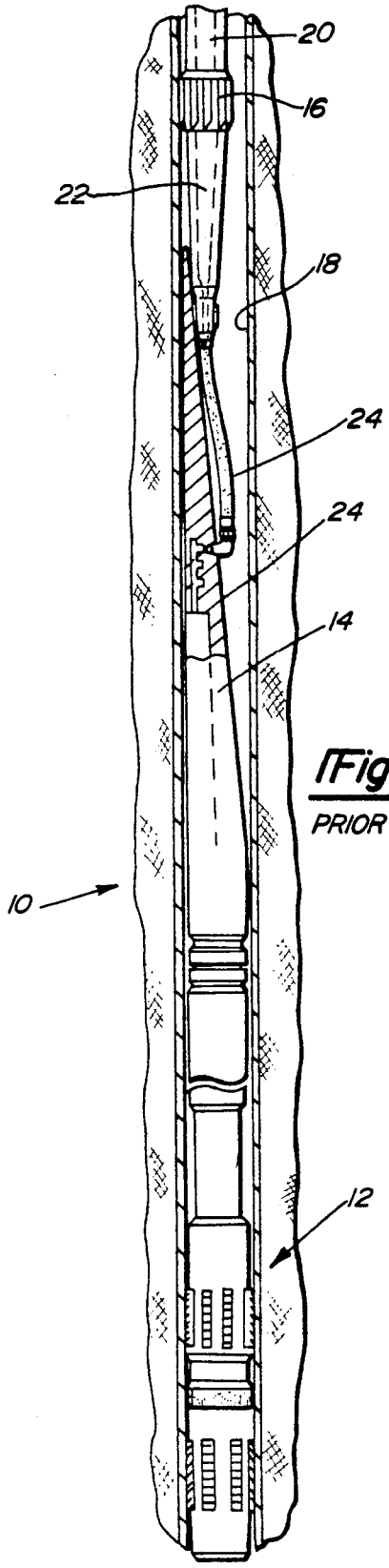
Fig-1 PRIOR ART
FIG. 1 is a partial cross-sectional perspective of a well bore with the whipstock apparatus of the prior art set within the well bore.
Figure 2:
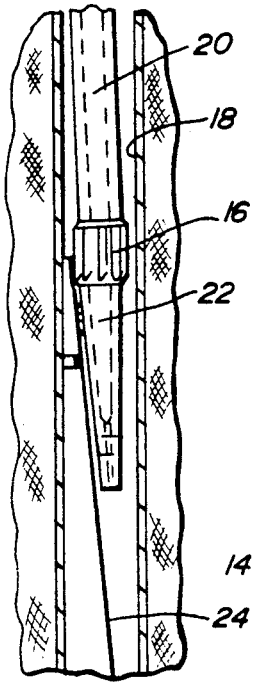
Fig-2 PRIOR ART
FIG. 2 is a partial cross-sectional perspective of the whipstock apparatus of the prior art with the starter mill detached from and travelling down the whipstock.
Figure 3:
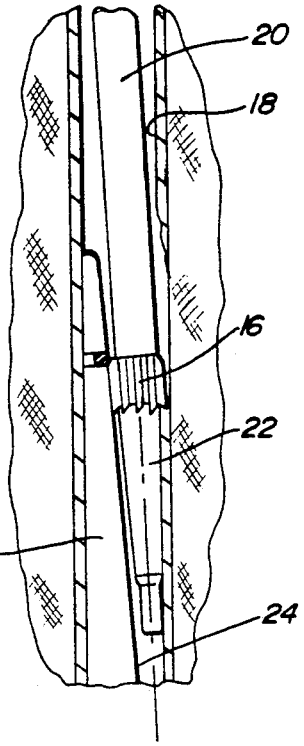
Fig-3 PRIOR ART
FIG. 3 is a partial cross-sectional perspective of the whipstock apparatus of the prior art with the starter mill having milled a portion of the casing wall.

The tattletale assembly of the present invention can be utilized with any number of oil tools where it is necessary to determine the relative position of one oil tool with respect to a second tool. However, for purposes of clarity, the present invention will be described in conjunction with a one-trip whipstock apparatus as shown in prior art FIGS. 1 through 3 of the drawing.

The one-trip whipstock apparatus 10 generally includes an anchor-packer 12 connected to the lower end of a whipstock 14. A starter mill 16 is detachably connected to the upper end of the whipstock 14 such that the entire assembly 10 can be set in the casing 18 of a well hole at the desired level and orientation in a single run of the well string 20. The milling tool 16 includes a longitudinal bore 22 for the supply of fluid under pressure through tube 24 to set the anchor-packer 12. Upon detachment of the mill 16 from the whipstock 14, the tube 24 will detach from the milling tool 16 to permit free movement and rotation of the milling tool 16. Once the anchor-packer 12 is set at the desired orientation, the milling tool 16 is detached from the whipstock 14 to allow the starter mill 16 to travel down the whipstock face 24 which will redirect the mill 16 into the casing 18 in order to mill a new borehole through the casing wall. Because of the nature of the milling tool 16, it is important that the milling operation be conducted only until the casing wall is milled through. Otherwise, damage to the whipstock face 24 or the mill 16 can result. In the past, the proper depth of milling was estimated utilizing the distance the drill string 20 was lowered. However, such estimates often proved unsatisfactory.

Referring now to FIGS. 4 through 9, there is shown the tattletale assembly 30 embodying the present invention for making an accurate determination of when the milling operation should be halted. As described above, the milling tool 16 includes a longitudinal bore 22 through which drilling fluid or the like is supplied under pressure to circulate through the milling tool 16. The bore 22 includes a restricted passageway at the end of the tool 16 which initially is connected to the tube 24 used to supply fluid to the anchor-packer 12. The tattletale assembly 30 includes a tattletale plug 32 which is preferably threadably mounted within a lateral port 34 formed in the peripheral wall of the mill 16. The port 34 provides fluid communication between the central bore 22 and the exterior of the tool. As best shown in FIGS. 7–9, the plug 32 includes a body portion 36 and a shear head 38. The shear head 38 is divided from the body 36 by a shear groove 40 extending around the shear head 38. Key grooves 42 may be provided on the body 36 to facilitate insertion of the plug 32 within the port 34 and subsequent removal of the sheared plug 32 using an appropriate key element (not shown).

The tattletale plug 32 has a partial bore 44 open to the interior end of the plug 32. Once inserted into the port 34, the partial bore will communicate with the central fluid passageway 22 of the tool 16. The partial bore 44 extends to a point in the plug 32 which will be beyond the peripheral wall of the tool 16. Preferably, the partial bore extends beyond the shear grooves 40 into the shear head 38 of the plug 32. In this manner, the partial bore 44 will be opened upon removal of the shear head 38 as will be subsequently described.

Figure 4:
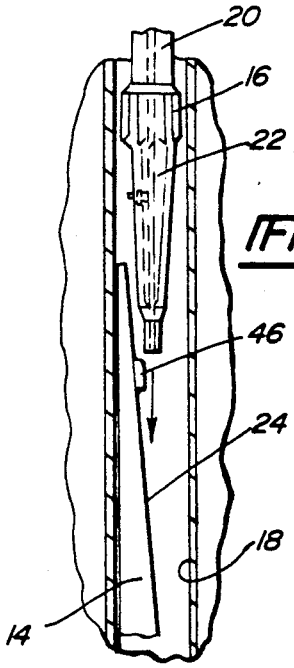
FIGURE 4 is a partial cross-sectional perspective of a whipstock apparatus embodying the present invention with the starter mill detached from and travelling down the whipstock.
Figure 5:
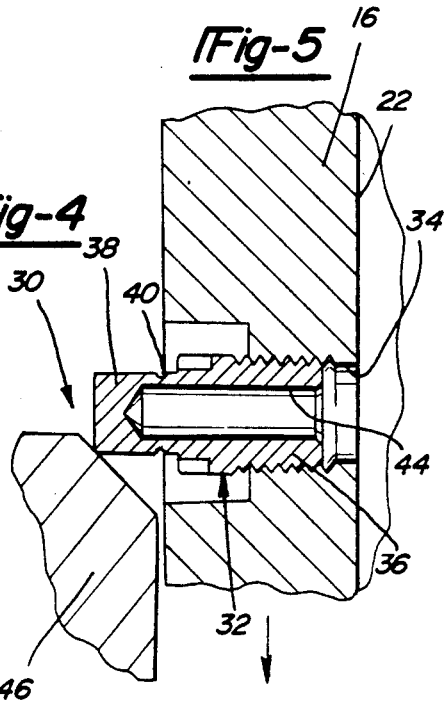
FIG. 5 is an enlarged cross-sectional perspective of the tattletale plug engaging the shear block of the present invention.

Referring to FIGS. 4–6, the tattletale assembly 30 embodying the present invention also includes a shear block 46 fixedly mounted to the whipstock face 24. The shear block 46 is mounted to the whipstock face 24 at a position whereby the tattletale plug 32 will engage the shear block 46 just as the mill 16 is cutting through the casing wall 18. The proper position can be readily determined since the thickness of the casing 18, the size of the mill 16 and the slope of the whipstock face 24 are all known. Furthermore, the tattletale plug 32 is preferably disposed downhole of the mill blades such that the plug 32 will engage the shear block 46 before the mill engages the block 46.

By providing the tattletale assembly 30 on a whipstock apparatus 10 or in any multiple tool operation, the relative position of a first tool, in this example the milling tool 16, with respect to a second tool, the whipstock 14, can be determined simply by monitoring the fluid pressure within the drill string 20. Drilling fluid is supplied at a known pressure through the inner bore 22 to operate various downhole tools. Although the end of the mill 16 is open to allow the release of fluid into the casing, the reduced diameter allows the maintenance of a certain pressure within the bore 22. Once the milling tool 16 is released from the whipstock 14, the work string 20 will be lowered to move the mill 16 downward along the whipstock face 24 and into the casing 18. As the mill 16 travels along the whipstock face 24 the tattletale plug 32 will eventually engage the shear block 46. As the tool continues to travel downhole the downward force will cause the plug 32 to push against the shear block 46 until the shear head 38 of the plug 32 is sheared from the body 36. If shear groove 40 is provided, the head 38 will shear at the groove 40.

At the moment the head 38 is sheared, the partial bore 44 will be opened creating a fluid path from the inner bore 22 to the exterior of the tool. Because the fluid within the bore 22 is under pressure, the establishment of the passageway will create a measurable pressure drop within the bore 22 which is discernible at the surface. When the operator measures the pressure drop it will be a signal to cease the milling operation and retrieve the tool.

The tattletale assembly 30 can be replaced and reused in subsequent operations. The sheared plug 32 can be removed by grasping the grooves 42 on the body 36 and rotating the body to threadably remove the remainder of the plug 32. For further operations, a new plug 32 can be inserted into the port 34.

The foregoing detailed description has been given for clearness of understanding only and no unnecessary limitations should be understood therefrom as some modifications will be obvious to those skilled in the art without departing from the scope and spirit of the appended claims.

I claim:

1. A tattletale assembly for use in a wellhole to determine the relative position of a first downhole tool with respect to a second downhole tool within the well hole, the first downhole tool including a longitudinal fluid passageway, said tattletale assembly comprising:

a tattletale plug mounted within a lateral port formed in a peripheral wall of the first downhole tool, said port providing fluid communication between the fluid passageway and the interior of the well casing, said plug preventing fluid communication between the passageway and the casing interior; and means for selectively opening said lateral port to allow fluid communication between the fluid passageway and the casing interior thereby creating a fluid pressure drop within the fluid passageway, said port being opened when the first downhole tool reaches a predetermined position with respect to the second downhole tool.

2. The tattletale assembly as defined in claim 1 wherein said tattletale plug includes a partial bore open to the fluid passageway, said partial bore extending beyond said peripheral wall of the first downhole tool.

3. The tattletale assembly as defined in claim 2 wherein said tattletale plug is replaceably mounted within said lateral port.

4. The tattletale assembly as defined in claim 3 wherein said tattletale plug is replaceably received within said lateral port.

5. The tattletale assembly as defined in claim 2 wherein said tattletale plug includes a shear head extending beyond said peripheral wall of the first downhole tool, said partial bore extending into said shear head.

6. The tattletale assembly as defined in claim 5 wherein said means for selectively opening said lateral port includes a shear block mounted to the second downhole tool at said predetermined position, said shear block engaging said tattletale plug to open said lateral port.

7. The tattletale assembly as defined in claim 6 wherein said shear block shears said head from said tattletale plug to open said partial bore allowing fluid communication between the fluid passageway and the casing interior causing said fluid pressure drop, said head being sheared as the first downhole tool reaches said predetermined position.

8. The tattletale assembly as defined in claim 5 wherein said tattletale plug includes a shear groove proximate said shear head.

9. The tattletale assembly as defined in claim 7 wherein said first downhole tool is a milling tool.

10. The tattletale assembly as defined in claim 9 wherein said second downhole tool is a whipstock having a redirecting face, said shear block mounted to said whipstock face.

11. In an apparatus for changing the direction of drilling through a well casing, the apparatus including a redirecting tool having a redirecting face and a milling tool having a longitudinal fluid passageway, a tattletale assembly for determining the position of the milling tool along the redirecting face, said tattletale assembly comprising:

a tattletale plug replaceably mounted within a lateral port formed in a peripheral wall of the milling tool, said port providing fluid communication between the fluid passageway and the interior of the well casing, said plug preventing fluid communication between the passageway and the casing interior; and a shear block mounted to the redirecting face at a predetermined position;

said shear block shearing said tattletale plug to open said lateral port when the milling tool reaches said predetermined position along the redirecting face, said open lateral port allowing fluid communication between the fluid passageway and the casing interior thereby creating a fluid pressure drop within the fluid passageway.

12. The tattletale assembly as defined in claim 11 wherein said tattletale plug includes a partial bore open to the fluid passageway, said partial bore extending beyond said peripheral wall of the milling tool.

13. The tattletale assembly as defined in claim 12 wherein said tattletale plug includes a shear head extending beyond said peripheral wall of the milling tool, said partial bore extending into said shear head, said shear head including an annular shear groove, said shear block shearing said tattletale plug at said shear groove to remove said shear head and open s id lateral port.

14. The tattletale assembly as defined in claim 11 wherein said tattletale plug is threadably received within said lateral port, said plug including key openings to facilitate removal and insertion of said plug.

15. A tattletale assembly for use in a wellhole to determine the relative position of a first downhole tool with respect to a second downhole tool within the well hole, the first downhole tool including a fluid passageway, said tattletale assembly comprising:

a shear block mounted to the second downhole tool at a predetermined position; and a tattletale plug mounted within a port formed in a peripheral wall of the first downhole tool, said port providing fluid communication between the fluid passageway and the well hole, said plug selectively preventing fluid communication between the passageway and the well hole;

said tattletale plug including a partial bore open to the fluid passageway, said shear block shearing said tattletale plug to open said partial bore when the first downhole tool reaches said predetermined position relative to said shear block on the second downhole tool, said open bore allowing fluid communication between the fluid passageway and the well hole thereby creating a fluid pressure drop within the fluid passageway of the first downhole tool which is measurable at the surface.

16. The tattletale assembly as defined in claim 15 wherein said tattletale plug is replaceably mounted within said port, said plug including a shear head extending beyond the peripheral wall of the first downhole tool, said partial bore extending into said shear head.

17. The tattletale assembly as defined in claim 16 wherein said port includes a plurality of threads and said plug includes a plurality of threads, said plug threadably received in said port 18. The tattletale assembly as defined in claim 17 wherein said plug includes key openings for rotating said plug with respect to said port.

19. The tattletale assembly as defined in claim 15 wherein said first downhole tool is a milling tool, said tattletale plug mounted to said milling tool downhole of the milling surface of said tool.

20. The tattletale assembly as defined in claim 19 wherein said second downhole tool is a whipstock having a redirecting face, said shear block mounted to said redirecting face of said whipstock such that said tattletale plug engages said shear block prior to the milling surface engaging said shear block.

21. The tattletale assembly as defined in claim 20 wherein said whipstock includes an anchor-packer integrally formed therewith to anchor said whipstock in the well hole.

22. The tattletale assembly as defined in claim 21 wherein said milling tool is releaseably connected to the upper end of said whipstock whereby said milling tool and whipstock may be run into the well hole in a single trip.

* * * * *